US006244884B1

(12) United States Patent
Kerul

(10) Patent No.: US 6,244,884 B1
(45) Date of Patent: Jun. 12, 2001

(54) SELF DOCKING ELECTRICAL CONNECTOR

(75) Inventor: Joseph Albert Kerul, Canton, MI (US)

(73) Assignee: Prestolite Wire Corporation, Southfield, MI (US)

( * ) Notice: Subject to any disclaimer, the term of this patent is extended or adjusted under 35 U.S.C. 154(b) by 0 days.

(21) Appl. No.: 09/505,308

(22) Filed: Feb. 16, 2000

(51) Int. Cl.[7] ..... H01R 13/15

(52) U.S. Cl. ..... 439/262; 439/34; 439/188; 439/660; 439/817; 200/51.1

(58) Field of Search ..... 439/188, 817, 439/260, 261, 262, 263, 264, 34, 660; 200/51.09, 51.1, 51.12

(56) References Cited

U.S. PATENT DOCUMENTS

| | | | | |
|---|---|---|---|---|
| 3,949,180 | * | 4/1976 | Ojima et al. | 200/51.1 |
| 3,951,494 | | 4/1976 | Romine . | |
| 4,349,238 | * | 9/1982 | Showman et al. | 339/75 |
| 4,508,405 | | 4/1985 | Damon et al. . | |
| 4,620,761 | | 11/1986 | Smith et al. . | |
| 4,859,199 | * | 8/1989 | Komatsu | 439/267 |
| 4,881,901 | | 11/1989 | Mendenhall et al. . | |
| 5,197,890 | | 3/1993 | Seymour . | |
| 5,447,442 | | 9/1995 | Swart . | |
| 5,552,959 | | 9/1996 | Penniman et al. . | |
| 5,993,232 | * | 11/1999 | Iguchi | 439/260 |

* cited by examiner

*Primary Examiner*—Paula Bradley
*Assistant Examiner*—Truc Nguyen
(74) *Attorney, Agent, or Firm*—Rader, Fishman & Grauer PLLC

(57) ABSTRACT

A self-docking connector includes first and third fixed contacts and an intermediate fixed contact. The first and third contacts are mounted on male and female connectors, respectively, and the intermediate contacts are mounted on a slideable plate. The plate is mounted on an upper tray surface of the female connector and is capable of sliding movement between a connected and a disconnected position. In the disconnected position, the intermediate contacts are resiliently biased by a biasing member away from contacting the third contacts, therefore creating an open circuit between the intermediate and third contacts. However, in the connected position, the intermediate contacts are forced into positive contact with the third contacts, thereby creating a readily disconnectable electrical connection therebetween.

12 Claims, 3 Drawing Sheets

SELF DOCKING ELECTRICAL CONNECTOR

FIELD OF THE INVENTION

The present invention relates to automotive electrical connections and more particularly to self-guiding electrical connections for connecting peripheral devices within an automobile.

BACKGROUND OF THE INVENTION

For economic reasons, automobile manufacture has become increasingly modularized and subdivided among various original equipment manufacturers and aftermarket parts suppliers. Accordingly, OEM electrical appliances within an automobile may originate from different sources. As a result, extensive efforts have been made to standardize electrical connections within the vehicle to accommodate multiple suppliers. Additionally, aftermarket appliances are increasingly made available directly to consumers. Often, installation of the aftermarket appliances requires that any electrical connection to the vehicle be made after first removing an existing component and then substituting the aftermarket appliance in its place.

For example, aftermarket vehicle console units are being made available to automobile purchasers that include various electronic and/or entertainment devices, such as sound and audio-visual entertainment systems. To replace an original equipment center console unit with an aftermarket one, the original unit first must be physically disconnected from the automobile before removal therefrom. Second, the original unit must be electrically disconnected from the vehicle before removal and before installation of the new aftermarket unit. Finally, once the new console is installed, it is not readily removable.

In existing automotive electrical system designs, disconnection of an existing appliance requires actual disconnection of wiring from the appliance, generally using a standardized plug and socket arrangement. Plug and socket connections are advantageous because they eliminate bare or open contact leads that may lead to inadvertent shorting of the automotive electrical system. However, modification of plug and socket connections once an automobile leaves a factory is extremely difficult. Also, exposed portions of plug and socket connections are always electrically charged. And plug and socket electrical connections are not conducive to repeated disconnection and removal of installed appliances, for example, as a method to prevent theft.

Additionally, often the location of an existing plug is incompatible with or remote from the socket on aftermarket appliances, or else the wire lead length is insufficient to easily interconnect to the new device. Moreover, in existing electrical system designs, electrically connecting a new device requires manually locating and physically reconnecting the socket and plug, either before or after physical installation of the new device, thereby adding to installation time and effort. Finally, in those systems where an existing appliance is not replaced, but is instead simply added, extensive time and effort are required to install the new unit, either because additional wiring must be added or because new electrical connections must be made to interface the new appliance with the automobile electrical system.

Accordingly, an easily connectable and disconnectable electrical connection is needed to provide simple and safe connection and disconnection of electrical appliances to an automobile electrical system without threatening the integrity of the electrical system.

SUMMARY OF THE INVENTION

The above-described disadvantages of current electrical connection systems are overcome by the self docking electrical connector of the present invention. The connector of the present invention includes first and third fixed contacts and an intermediate fixed sliding contact. The first and third contacts are mounted on male and female connectors, respectively, and the intermediate contacts are mounted on a slideable plate.

In the preferred embodiment, the plate is slideably mounted on an upper tray surface of the female connector and is capable of sliding movement between a connected and a disconnected position. In the disconnected position, the intermediate contacts are resiliently biased by a biasing member away from contacting the third contacts, therefore creating an open circuit between the intermediate and third contacts. However, in the connected position, the intermediate contacts are forced into positive contact with the third contacts, thereby creating an electrical connection therebetween.

The male member includes at least one actuator post extending outwardly from a main body of the male member. A distal end of an actuator post projection includes a first cam surface designed to interact with a second cam surface located on an upper surface of the plate. Most preferably, the actuator post extends normal to the male body such that the angle of incidence of the actuator post onto the upper surface of the plate is approximately normal to the upper surface of the plate.

In operation, the male body is brought into facing contact with the female body such that the first cam surface on the actuator post projection contacts the second cam surface on the upper surface of the slideable plate. As the first and second cam surfaces interact, a lateral force is exerted on the plate sufficient to overcome the resilient biasing force of the biasing member, forcing the plate to slidably move from the disconnected to the connected position. When the actuator post is fully inserted into the female member, the slideable plate will have completely moved to the connected position, thereby causing an electrical connection between the intermediate and the third contacts. Moreover, when the actuator post is fully inserted, the first contacts mounted on the male connector are forced into positive electrical contact with the intermediate contacts, thereby forming a complete circuit between the first, intermediate and third contacts, and therefore between the male and the female connectors. Importantly, the resilient member is not itself used as an electrical conductor. Instead, opposed cam surfaces on respective male and female connectors slide a fixed intermediate contact mounted on the female connector into electrical engagement with first and third contacts rigidly retained on the male and female member, respectively. Therefore, the resiliently biased slideable plate is actuated as a cam follower by the male connector actuator post inserted at an angle normal to the sliding plate. Additionally, the actuator post may be sufficiently large to provide structural support to any device attached to the male connectors. To save space, the plate is mounted to the female connector. However, the slidable plate may be mounted in any convenient place to accomplish sliding motion between an engaged and disengaged positions. For instance, the slidable plate may be mounted to the male connector if desired, but if mounted to the male connector, which is inserted into the female connector, then the male extension would have to be made longer.

Using the self docking electrical connector of the present invention, an automotive peripheral electrical device may be quickly and easily attached and detached from the automotive electrical system. The connector is flexible, because the terminals may transmit any type of information, including electrical current or control information (including fiberoptic data transmission).

Because the slideable plate is resiliently biased to a disconnected position, the connector is preferentially uncharged. Thus, the intermediate terminals pose no danger to the automotive electrical system (through shorts or grounds) when the male connector is not attached to the female connector, and may therefore be exposed and easily accessible. The connector therefore provides a simple yet inherently stable electrical connection mechanism that may be utilized with both original equipment and aftermarket appliances such as seats, instrument clusters, switches, restraint systems or any other device requiring electrical coupling within the vehicle.

BRIEF DESCRIPTION OF THE DRAWINGS

The features and advantages of the present invention will be apparent to one of ordinary skill and art from the detailed description of the invention that follows and from the accompanying drawings, wherein.

DETAILED DESCRIPTION OF PREFERRED EMBODIMENTS

Figure 1:
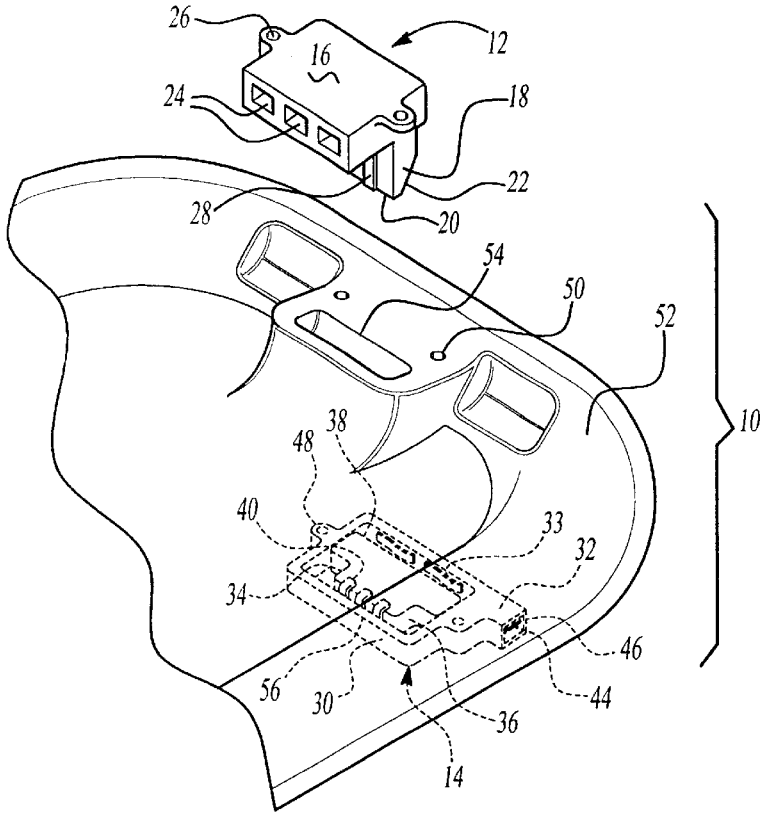
FIG. 1 is an exploded view of a first embodiment of the male and female electrical connectors of the present invention, including a mounting point for the female connector.
Figure 2:
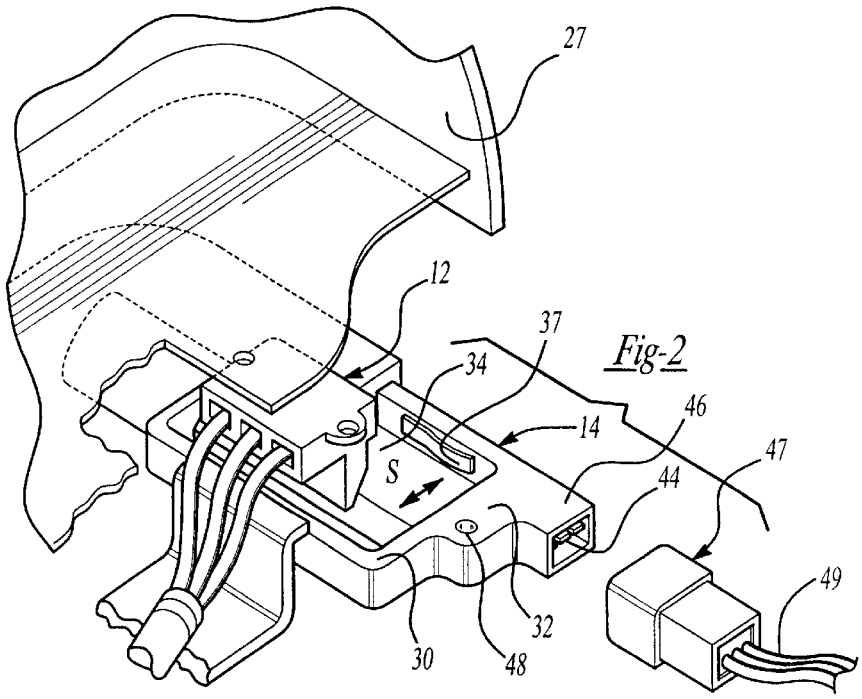
FIG. 2 is a second perspective view of the connectors of FIG. 1 includes a mounting surface for the male connector.
Figure 3:
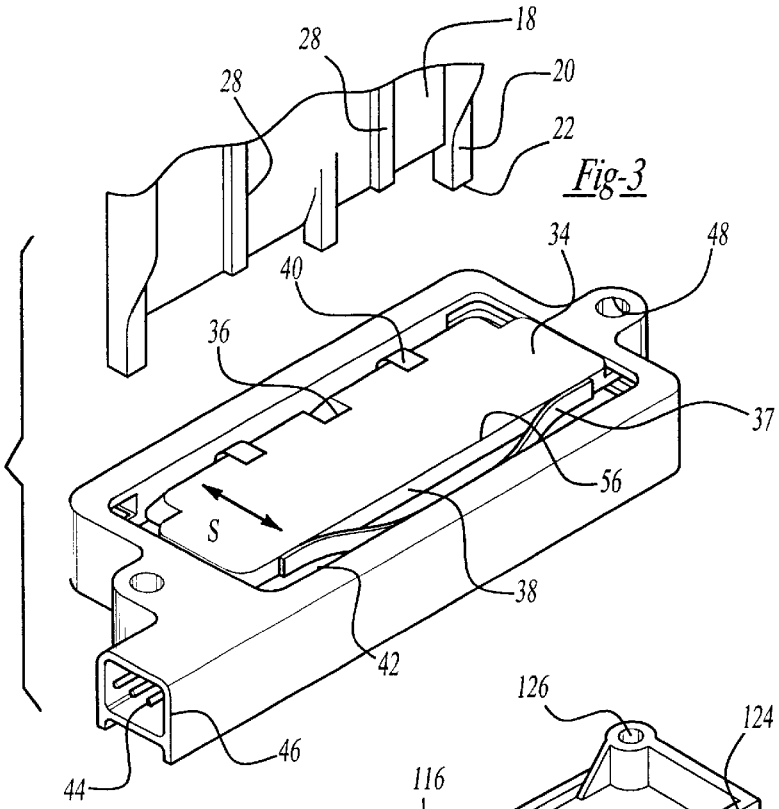
FIG. 3 is a third perspective view of the first embodiment of the present invention.

A first embodiment of a self-docking electrical connection system 10 is shown in FIGS. 1, 2 and 3, including a male connector 12 and a female connector 14. Male connector 12 includes a body 16 and at least one actuator post 18 extending in a direction normal to the body. As seen in FIGS. 1 and 3, actuator post 18 may be a single continuous post having a width identical to body 16, or the actuator post may be of any convenient shape. Both body 16 and actuation post 18 are made of nonconductive material such as injection molded nylon or similar material that provides both electrically insulative and structural properties. Actuator post 18 includes at least one projection 20 extending distally beyond post 18. The tip of each projection 20 includes a first cam surface 22 to help ease the coupling between the male and female members, as described more fully below.

Male connector 12 also includes terminal connection areas 24, and may include mounting apertures 26 positioned in any convenient place. Preferably, mounting apertures 26 receive fasteners (not shown) that are used to secure male connector 12 adjacent an outer surface of an appliance 27 (see FIG. 2) that is to be installed in a vehicle. Additionally, connection areas 24 provide locations for interfacing electrical connections between the connector and the appliance. A first set of fixed contacts 28 are mounted on male connector 12, and preferably include at least a portion mounted on actuator post 18 in electrical communication with connection areas 24. The number of contacts 28 (and connection areas 24) may be adjusted to accommodate the amount of power or information that must be transmitted to the peripheral electrical device.

Female member 14 includes a tray-shaped base 30 that includes an upper surface 32. A plate 34 is slidably mounted relative to surface 32. Plate 34 includes second cam surfaces 36 designed to receive and mate with the first cam surfaces 22 on actuator post 18.

Plate 34 also includes a second or intermediate set of contacts 40 that correspond in number and align with the first contacts 28 when the actuator post 18 is properly inserted into the female member 14. Additionally, base 30 includes a third set of fixed contacts 42 that correspond in number and align with second set 40. At least one biasing member 37 is mounted on surface 32 and interacts with plate 34 at an edge 38. Biasing member 37 may take the form of a leaf spring, as shown in FIGS. 1, 2 and 3, or more preferably, may be one or more coil springs 137 (seen in FIG. 4). Under the influence of biasing member 37 and absent any external force being applied, plate 34 is forced to slide along axis S in a direction away from biasing member 37 to a first, or disconnected, position. In the disconnected position, intermediate and third contacts 40, 42 are not in electrical contact with each other because biasing member 37 forces plate 34, including intermediate contacts 40, away from third contacts 42. However, if lateral force is applied to plate 34 sufficient to overcome the force applied by the biasing member, plate 34 may slide along axis S to a second, or connected position, where intermediate and third contacts 40, 42 are forced into positive engagement with each other, thereby completing an electrical circuit.

Female member further includes at least one set of terminal connection areas 44 that allow female member 14 to interface with the existing automotive electrical system to transfer power and/or information through the connector 10. In FIGS. 1, 2 and 3, connection areas 44 are housed within a molded socket 46 that may be easily attached to a pre-existing plug 47 when female connector 14 is installed during vehicle manufacture. However, any convenient type of connection between female connector 14 and the wires 49 within a vehicle electrical system may be utilized.

Finally, female member 14 may include mounting apertures 48 that receive fasteners for mounting member 14 to corresponding apertures 50 in a vehicle tray 52 (see FIG. 1). Optionally, tray 52 may include a cutout 54 sized to expose only a portion of plate 34 upper surface 56, including cam surfaces 36. Of course, a portion of second terminal set 40 may be exposed as well. However, since plate 34 is biased to the disconnected position when male connector 12 is not installed, no electrical potential is applied to second terminal set 40 when exposed, so the exposed terminals pose no danger to the vehicle electrical system.

Figure 4:
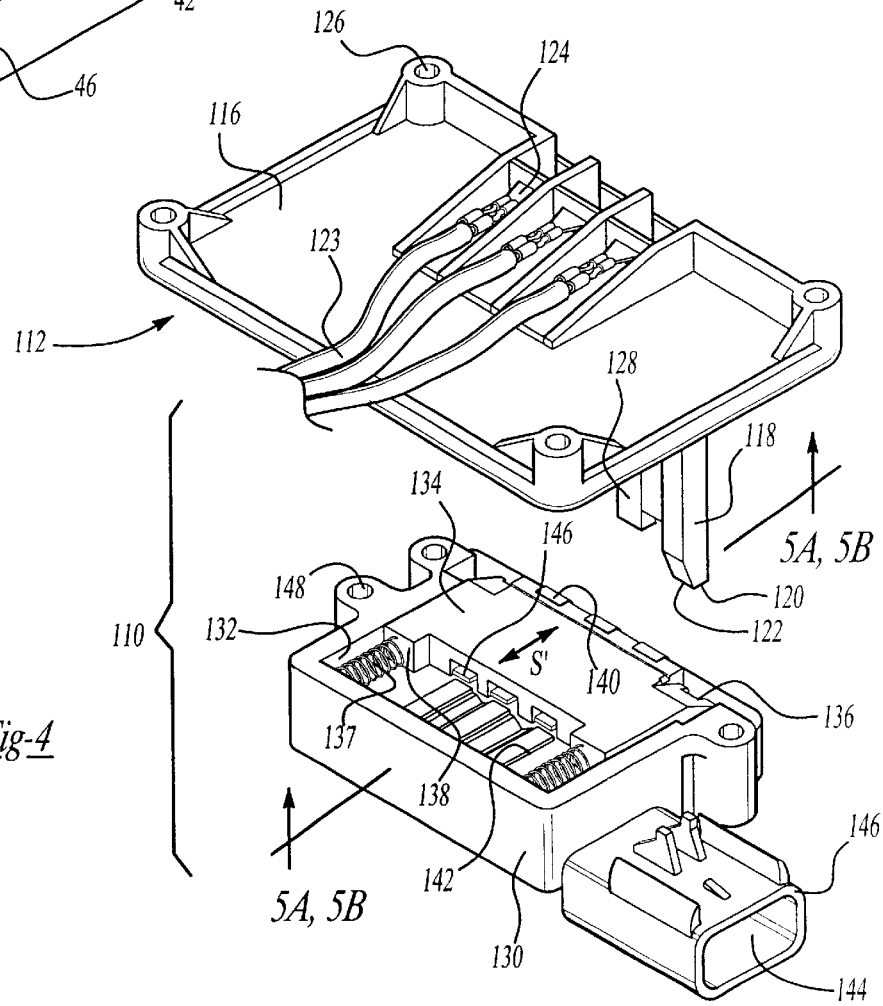
FIG. 4 is a perspective view showing a second embodiment of the self docking electrical connector of the present invention.

A second and preferred embodiment of an electrical connector 110 is illustrated in FIGS. 4 and 5. Connector 110 has a structure similar to the connector 10 shown in FIGS. 1, 2 and 3 and accordingly, similar reference numbers will indicate similar structure. In particular, a male body 112 is shown having a base 116 with at least one actuator post 118 extending generally normal to base 116. Post 118 includes distal projections 120 having first cam surfaces 122 at each projection tip. Wire leads 123 interconnect with terminal connections 124, thereby providing an electrical interface between the male connector 112 and any peripheral electrical device. Terminal connections 124 are also electrically connected to first fixed terminals 128 mounted on actuator posts 118.

Male body 112 includes mounting apertures 126 conveniently positioned at each of four corners of base 112, though the mounting configuration may vary. Preferably, mounting apertures 126 receive fasteners (not shown) that are used to secure body 12 to a peripheral electrical device that is to be installed in a vehicle.

Male body 112 is adopted to engage and mate with female body 114. Female body 114 includes a base 130 that includes a tray-shaped upper surface 132. A plate 134 is slidably mounted on surface 132 adapted to slide along an axis S'. Plate 134 further includes second cam surfaces 136 designed to receive and mate with the first cam surfaces 122 on projections 120. Either or both of surfaces 122, 136 are formed so that when the surfaces mate with each other, the plate 134 is forced to move laterally.

Plate 134 also includes an intermediate set of contacts 140 that correspond in number and align with the first contacts 128 when the actuator post 118 is properly inserted into the female member 114. Additionally, base 130 includes a third set of fixed contacts 142 that correspond in number and align with second set 140. At least one coil spring 137 is mounted on surface 132 and interacts with plate 134 at an edge 138. Under the influence of spring 137, plate 134 is forced to slide along axis S' in a direction away from spring 137 to a first, or disconnected, positions shown in FIGS. 4 and 5A. Therefore, in the disconnected position, intermediate and third contacts 140, 142 are not in electrical contact with each other because spring 137 forces plate 134, including intermediate contacts 140, away from third contacts 142. However, if force is applied to plate 134 sufficient to overcome the force applied by the biasing member, plate 134 may slide along axis S' toward springs 137 to a second, or connected position (shown in FIG. 5B), where intermediate and third contacts 140, 142 are forced into positive engagement with each other.

Female member 114 also includes at least one set of terminal connections 144 that allow female member 114 to interface with the existing automotive electrical system to transfer power and/or information through the connector 110. As above, connection areas 144 are housed within a molded socket 146 that may be easily attached to a pre-existing plug (not shown). Finally, female member 114 may include mounting apertures 148 that receive fasteners for mounting member 114 to the vehicle.

Figure 5A:
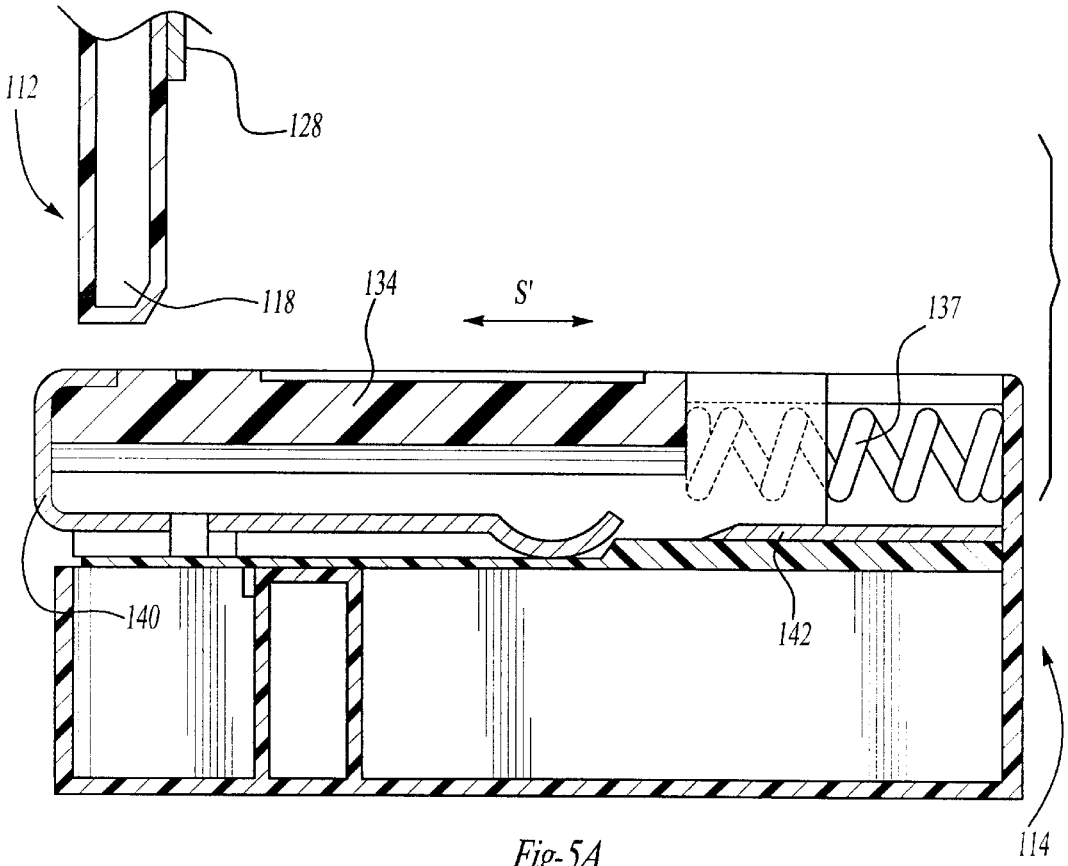
FIG. 5A is a first cross-sectional view of an assembled second embodiment connector showing the terminals in the disconnected position.
Figure 5B:
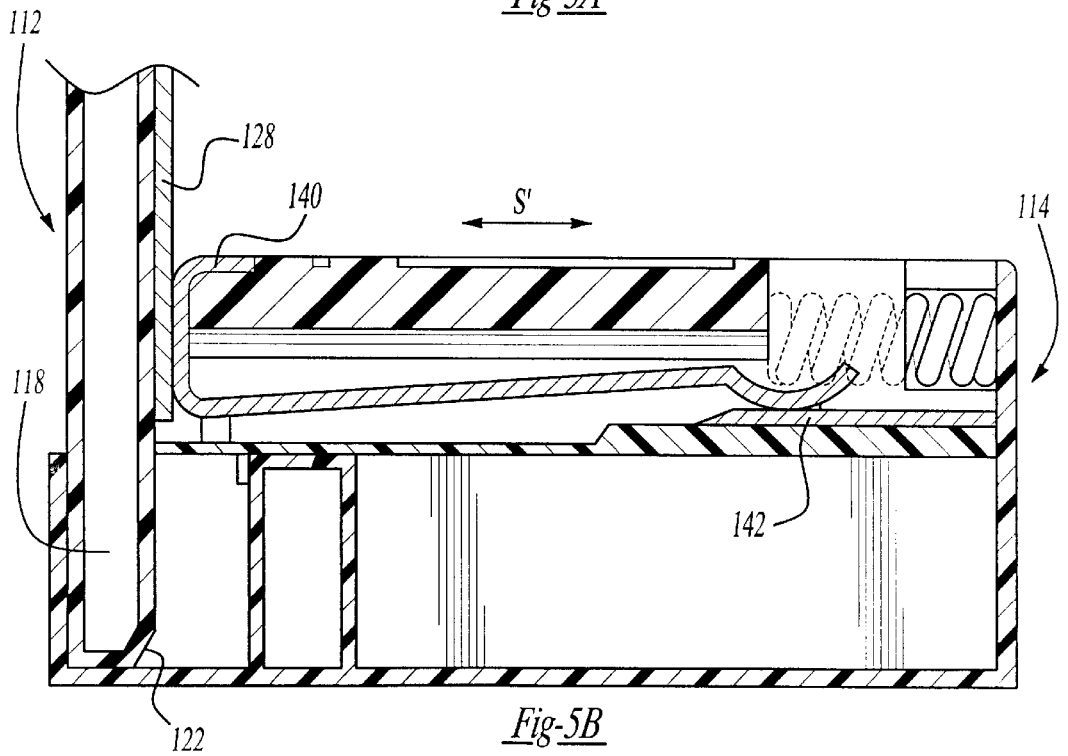
FIG. 5B is a second cross-sectional view of an assembled second embodiment showing the terminals in the connected position.

Proper operation of the inventive connector 110 will be described with reference to FIGS. 5A and 5B. It should be understood that the connector 10 of FIGS. 1, 2 and 3 operates in substantially the same manner. To utilize the inventive connector, male connector 112, and any peripheral electrical component attached thereto, is aligned so that actuator post 118 is oriented above the exposed portion of plate 134. In particular, first and second cam surfaces 122, 136 are aligned into mating contact with each other. Under normal circumstances, plate 134 is biased in away from spring 137 to an electrically disconnected position such that second contacts 140 are biased away from contacting third contacts 142, thus preventing an electrical interconnection between the second and third terminal sets. Accordingly, when at rest, plate 134 is biased into the disconnected position.

However, as additional force is exerted through actuator post 118 normal to the sliding axis S' of plate 134, the cam surfaces interact and force plate 134 to slide laterally along axis S' toward spring 137 and away from the disconnected position. As plate 134 slides laterally, an opening sized to receive actuator post 118 is revealed in the female body member below plate 134 so that post 118 may be fully inserted into female body member 130.

As plate 134 slides laterally, intermediate contacts 140 move with the plate along axis S' towards the third contacts 142. When actuator post 118 is fully inserted and plate 134 has moved a predetermined distance along axis S' away from springs 137, intermediate and third contacts 140, 142 are forced into positive engagement with each other, creating an electrical contact therebetween. Additionally, when post 118 is fully inserted, first contacts 128 are forced into positive engagement with intermediate contacts 140, thereby completing a circuit between first and third contacts 128, 142 through intermediate contacts 140. In this way, easy electrical interconnection may be accomplished between connection areas 144 and wires 123 (FIG. 4) through movement of plate 134 from a disconnected to a connected position, and therefore between a peripheral electrical device and the vehicle electrical system. Moreover, the size and length of actuator post 118 may be adjusted to provide sufficient structural support to the peripheral electrical device, if desired. Thus, the connector 110 may provide both electrical and structural interconnection between the vehicle and any peripheral electrical device.

Importantly, the resilient member 37 or 137 does not itself create an electrical connection. Instead, the slideable plate 34, 134 is actuated as a cam follower to mechanically place three fixed electrical contacts into positive electrical communication with each other. Additionally, mounting the plate 34, 134 to the female connector 14, 114 saves space and minimizes the risk of inadvertent damage to any projections extending from the male connector 12, 112.

The self-docking and readily disconnectable nature of the inventive connector makes it ideal for removable and portable appliances. In one application, the connector of the present invention may be used in conjunction with existing socket and plug arrangements in vehicles when installing new aftermarket appliances. In another application, the connector, and especially the female portion of the connector, may be pre-installed at various locations in new vehicles to enable modification and upgrading of vehicle appliances by the manufacturer, the dealer or even the consumer, requiring only that new appliances include the male portion for proper fit and placement.

Thus, the present invention allows fast and easy mechanical and electrical coupling between any peripheral electrical component and a vehicle electrical or control system. The connector may be easily modified to couple with any type of component, and may transfer any type of electrical impulse, including power. Since both male and female connectors are fixed in place, installation of peripheral components is rapid, eliminating time consuming wiring requirements. Additionally, since the connector is dormant (i.e. not charged with electricity) until both the male and female connectors are mated, the integrity of the vehicle electrical system is not challenged by leaving a portion of the connection exposed and readily accessible.

The disclosed embodiments and examples are given to illustrate the present invention. However, they are not meant to limit the scope and spirit of the present invention. Therefore, the present invention should be limited only by the appended claims.

What is claimed is:

1. A self-docking electrical connector, comprising:

first and third fixed contacts respectively mounted on male and female bodies, said female body including a recess for receiving at least a portion of said male body; and a slidable plate including intermediate contacts fixed thereto, said plate sliding in response to insertion of said male body into said female body from a disconnected position, wherein said third and intermediate contacts are spaced apart in said disconnected position, and wherein said third and intermediate contacts positively engage each other in a connected position.

2. The connector of claim 1, wherein said plate is resiliently biased to said disconnected position when said male body is not inserted into said female body.

3. The connector of claim 1, wherein said plate is mounted on an upper surface of said female body.

4. A self-docking electrical connector, comprising:

first and third fixed contacts respectively mounted on male and female bodies, said female body including a recess for receiving at least a portion of said male body; and a slidable plate mounted on an upper surface of said female body, said plate including intermediate contacts fixed thereto, said plate sliding in response to insertion of said male body into said female body from a disconnected position, wherein said third and intermediate contacts are spaced apart in said disconnected position, and wherein said third and intermediate contacts positively engage each other in a connected position.

5. The connector of claim 4, wherein said male body includes at least one actuator post for insertion into said recess, said at least one actuator post including at least one projection, a distal end of said projection including a first cam surface for interacting with an upper surface of said plate to force said plate to slide from said disconnected to said connected position.

6. The connector of claim 5, wherein said plate upper surface includes a second cam surface adapted to mate with said first cam surface to exert a lateral force on said plate.

7. The connector of claim 5, wherein said post extends generally normal to said male body such that the angle of incidence of said post onto said plate upper surface is approximately normal to the upper surface of the plate.

8. The connector of claim 7, wherein said plate is resiliently biased to said disconnected position when said post is not inserted into said female body.

9. The connector of claim 4, wherein said female body further includes a socket for coupling said third contacts to an electrical system.

10. A self-docking electrical connector, comprising:

first and third fixed contacts respectively mounted on male and female bodies, said female body including a recess for receiving at least a portion of said male body;

a slidable plate mounted on an upper surface of said female body, said plate including intermediate contacts fixed thereto, said plate sliding in response to insertion of said male body into said female body from a disconnected position, wherein said third and intermediate contacts are spaced apart in said disconnected position, wherein said third and intermediate contacts positively engage each other in a connected position; and a spring attached between a side edge of said plate and said female body upper surface wherein said spring resiliently biases said plate to said disconnected position when said post is not inserted into said female body.

11. The connector of claim 10, wherein said spring is a leaf spring.

12. The connector of claim 10, wherein said spring is a coil spring.

* * * * *